US009925689B2

(12) United States Patent
Fontana et al.

(10) Patent No.: US 9,925,689 B2
(45) Date of Patent: Mar. 27, 2018

(54) MACHINE FOR THE PRODUCTION OF CERAMIC PRODUCTS

(71) Applicant: SACMI COOPERATIVA MECCANICI IMOLA SOCIETA'COOPERATIVA, Imola (IT)

(72) Inventors: Francesco Fontana, San Lazzaro di Savena (IT); Giorgio Sarani, Borgo Tossignano (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 0 days.

(21) Appl. No.: 15/112,596

(22) PCT Filed: Mar. 26, 2015

(86) PCT No.: PCT/IB2015/052241
§ 371 (c)(1),
(2) Date: Jul. 19, 2016

(87) PCT Pub. No.: WO2015/150992
PCT Pub. Date: Oct. 8, 2015

(65) Prior Publication Data

US 2017/0113375 A1 Apr. 27, 2017

(30) Foreign Application Priority Data

Mar. 31, 2014 (IT) ..... BO2014A0176

(51) Int. Cl.
*B28B 1/28* (2006.01)
*B28B 1/26* (2006.01)

(52) U.S. Cl.
CPC ..... *B28B 1/28* (2013.01); *B28B 1/266* (2013.01)

(58) Field of Classification Search
CPC ..... B28B 1/266; B28B 1/28
See application file for complete search history.

(56) References Cited

U.S. PATENT DOCUMENTS 4,043,737 A * 8/1977 Greenberg ..... B28B 1/266 425/434
5,156,855 A 10/1992 Hisatomi et al.
6,428,643 B1 * 8/2002 Bergquist ..... B28B 1/002 156/242

FOREIGN PATENT DOCUMENTS

CN 1054557 A 9/1991
CN 2 342 960 Y 10/1999
(Continued)

*Primary Examiner* — James P Mackey
(74) *Attorney, Agent, or Firm* — Pearne & Gordon LLP

(57) ABSTRACT

A machine (1) for the production of ceramic products includes: a mould (2) made up of two parts (3, 4) designed to define, in a closed configuration, a cavity for casting the product; an apparatus (5) for clamping and containing the mould (2) acting on the mould (2) in its closed configuration; a frame (7) for supporting the mould (2) and clamping and containing apparatus (5). The machine includes a supporting base, interposed between the supporting frame (7) and a walkable surface (P), having a first portion (8) pivoted to the frame (7) to allow the supporting frame (7) to rotate relative to the walkable surface (P) and a second portion (9), spaced from the first portion (8) and equipped with at least one actuator element (10, 11) connected to the supporting frame (7) to incline the supporting frame (7) at least from a first limit operating position, where the supporting frame (7) is inclined by a first angle (α or β) relative to the walkable surface (P), to a second limit operating position, where the supporting frame (7) is inclined by a second angle (α or β) which is different from the first angle (α or β), relative to the walkable surface (P).

10 Claims, 9 Drawing Sheets

(56) References Cited

FOREIGN PATENT DOCUMENTS

| | | | |
|---|---|---|---|
| CN | 102837354 | A | 12/2012 |
| DE | 4324684 | C1 | 9/1994 |
| EP | 0 427 184 | A2 | 5/1991 |
| EP | 0 561 613 | A1 | 9/1993 |
| EP | 2 366 517 | A1 | 9/2011 |
| JP | H11-300718 | A | 11/1999 |

* cited by examiner

MACHINE FOR THE PRODUCTION OF CERAMIC PRODUCTS

TECHNICAL FIELD

The present invention relates to a machine for the production of ceramic products, in particular ceramic sanitaryware.

The various types of machines for the production of ceramic products comprise primary elements, such as the mould, the clamping units and the containing units, and shared auxiliary elements, such as, for example, the fixed machine frames, the units or plates for supporting and moving the mould, which can vary depending on the type of products to be made, which may be washbasins, toilet bowls, bidets, shower trays, etc.

BACKGROUND ART

The machines of particular relevance for this invention are, for example, but without restricting the scope of the invention, those for making toilet bowls or bidets.

A prior art type of machine is described in patent EP 2 366 517 in the name of the same Applicant.

This machine comprises:

- a mould made up of at least two parts designed to define, in a closed configuration, an internal cavity for casting the product;
- a body for clamping and containing the mould with a tubular shape, open at the ends;
- means for the relative movement between the clamping and containing body and the mould to enable a relative sliding, along a single movement axis (normally horizontal), between the clamping and containing body and the mould in a closed configuration between an operating position, where the mould and the clamping and containing body are moved away from each other, and a second operating position, where the mould and the clamping and containing body are matchingly coupled inside one another.

In the preferred embodiment the clamping and containing body is moved towards and away from the mould.

In light of this, the tubular clamping and containing body is equipped with slides (wheels) resting on a pair of rails forming part of a supporting frame of the mould and of the clamping body.

In a solution known from patent document EP 2 366 517, the clamping and containing body is a tubular body comprising, inside it, at least one inflatable element for clamping the mould and/or containing the forces acting on the mould.

In light of this, the inflatable element (or the two or more elements, depending on the geometrical architecture of the tubular body) can be supplied with a fluid under pressure between a first non-operating, limit configuration of minimum pressure and reduced size and a second operating, limit configuration of maximum pressure and maximum size.

The frame is placed on a walkable surface and comprises:

- a zone for operating and supporting the component parts of the mould and
- a zone for positioning the clamping and containing body when it is moved away from the mould. The two zones are located at two different points of the frame (ends of the frame).

In the zone for operating and supporting the mould of the frame there are service means for the cavity formed by the parts of the mould, such as means for feeding the fluid (slip) into the mould and injection of air for drainage and slip consolidation during the product casting cycle.

Also in the operating zone of the mould there are service means for a drainage system.

The drainage system is located inside porous moulds to allow the fluids that go through the inside surfaces of the mould during the casting cycle to be channelled to the outside, or to pump fluids in under pressure in the opposite direction in order to detach the moulded product from the mould walls or to recondition the mould part.

The machine components described above are positioned in a work island which comprises a servo assisted device for demoulding the product made or, alternatively, a robotized unit used for the same purpose but which can, if necessary, be designed to perform other functions for processing and finishing the moulded product.

The same robotized unit, if present, may be suitably equipped to replace parts of the mould from the operating zone of the frame.

However, the various types of machines for the production of ceramic products, including the one just described, have some drawbacks.

A first drawback is due to the impossibility of completely and effectively emptying from the cavity of the mould the excess liquids which have been left inside the cavity at the end of the casting cycle, particularly in the case of products with very complex shapes.

This problem is also caused by the fact that the mould is static and rests on a surface which is horizontal (or, at most, inclined by a few degrees relative to the walkable surface).

This feature of the machine (fixed position) results in an incomplete emptying of the excess fluids (due to gravity, slow and gradual) causing a worsening of the quality of the product or, in extreme cases, the rejection of the product.

For this reason, it is not technically possible to obtain products with complex shapes on the current machines.

Known in the prior art are some technical solutions to this problem. One of these solutions is described in document EP 0 427 184.

This document describes a pressure slip casting apparatus comprising a mould having a moulding cavity and positioned on a surface of a supporting table. The supporting table has tilting means for tilting the mould about a pivot axis by a first angle to the horizontal walkable surface. A second drawback is due to what is known as the problem of "coagulation" or "flocculation" or joint line as the level of the slip rises or "grows" inside the mould, leading to serious defects that make the quality of the end product unacceptable.

This problem arises especially in the case of liquid-cast products where there is a maximum freedom of form for the products and where, obviously, the mould may have different dimensional ratios within it and the casting cavities may be very large.

In effect, the mould cavity is not simply divided into male and female parts and, instead, the walls of the product are formed by a single surface within the mould.

The problem occurs inside the mould when the slip is fed in under pressure (usually from the bottom) and gradually "grows" inside the mould, its level rising until it completely fills the cavity.

The actual causes of the problem are still not clear although laboratory tests have indicated the following as the principal factors involved: the large volume of the mould, the relative internal air volume and the force of gravity.

Whatever the causes, the fact remains that, as the mould fills, the different substances in the slip tend to "separate out" in random fashion: that is because the slip is not a perfectly homogeneous mixture but is basically a suspension, in water, of clay and other substances with different specific weights which, as the level of the slip increases, leads to the separation between the substances of lower specific weight (tending to rise to the surface) and those of higher specific weight (tending to sink).

The separation process as the mould fills may lead to thickening or agglomeration of like substances separated from the different substances surrounding them.

The result of the agglomeration is the presence, on the surface of the rising slip, of a sort of coloured "stain" indicating the non-homogeneousness of the mixture: if this stain comes into contact with the surface of the mould, the product develops a flaw at that point.

The flaw, however, only becomes visible after the product is fired or finally glazed and appears as a clearly visible surface defect (for example in the form of a hump or recess) making it necessary to reject the product.

AIM OF THE INVENTION

The aim of this invention is to provide a machine for the production of ceramic products, in particular ceramic sanitaryware, which overcomes the above mentioned drawbacks of the prior art.

More specifically, the aim of this invention is to provide a machine for the production of ceramic products, in particular ceramic sanitaryware, which is able to increase the quality of the end product and also allow the production of products with complex profiles.

A further aim of this invention is to provide a machine for the production of ceramic products, in particular ceramic sanitaryware, which is able to ensure reliable production without modifying the base structure of the mould and containment body.

These aims are fully achieved by the machine for the production of ceramic products, in particular ceramic sanitaryware according to the invention as characterized in the appended claims.

More specifically, the machine for the production of ceramic products comprises a mould made up of at least two parts designed to define, in a closed configuration, a cavity for casting the product.

The machine also comprises means for clamping and containing the mould acting on the mould in its closed configuration. According to the invention, the machine comprises a supporting' base interposed between the supporting frame and a walkable surface.

Also according to the invention, the supporting base has a first portion pivoted to the frame to allow rotating the supporting frame relative to the walkable surface.

Also according to the invention, the supporting base has a second portion, spaced from the first portion, and equipped with at least one actuator element connected to the supporting frame to incline the supporting frame at least from a first limit operating position, where the supporting frame is inclined by a first angle relative to the walkable surface, to a second limit operating position, where the supporting frame is inclined by a second angle which is different from the first angle and again relative to the walkable surface.

According to the invention, the frame has an axis of longitudinal extension. Also according to the invention, the first portion of the supporting base is articulated to the frame with a first axis of rotation lying in a plane passing through the longitudinal axis of extension of the frame to allow a first rotation of the frame, relative to the walkable surface between the two limit operating positions. Thanks to this structure of the frame, the mould (and the respective clamping and containing means) can be raised and/or rotated by angles such as to allow:

- a rapid, sure and complete discharge of excess liquids from the mould, irrespective of the complexity of the shape of the product
- keeping in a homogeneous state the slip fed in during the step of filling the moulding cavity so as to move the flocculation or joint to positions where they do not cause damage to the surfaces of the product being formed.

Preferably, the first portion of the supporting base is articulated to the frame with a second axis of rotation lying in a plane at right angles to the longitudinal axis of extension of the frame to allow a second rotation of the frame, relative to the walkable surface between the two limit operating positions.

Therefore, the frame may be inclined in two different ways thanks also to a single portion having with two different axes of rotation (or pivot points).

The first axis of rotation allows a rotation (that is, sideways inclination) of the frame (and therefore also of the mould) to ensure the correct homogeneity of the slip and the movement of the joint lines.

The second axis of rotation allows raising one end of the frame (thereby inclining the mould) to allow emptying the excess fluids.

The structure of the frame is extremely reduced in size and the elements for moving the frame are positioned within the dimensions of the frame. Therefore, keeping the same dimensions, the frame may be, preferably, firstly raised at one end (inclination) and, subsequently rotated (rotation), in order to better mix the slip fed into the mould and make it more homogeneous during the step of forming the product.

BRIEF DESCRIPTION OF DRAWINGS

These and other features will become more apparent from the following detailed description of a preferred, non-limiting embodiment of the invention, with reference to the accompanying drawings, in which.

DETAILED DESCRIPTION OF PREFERRED EMBODIMENTS OF THE INVENTION

Figure 1:
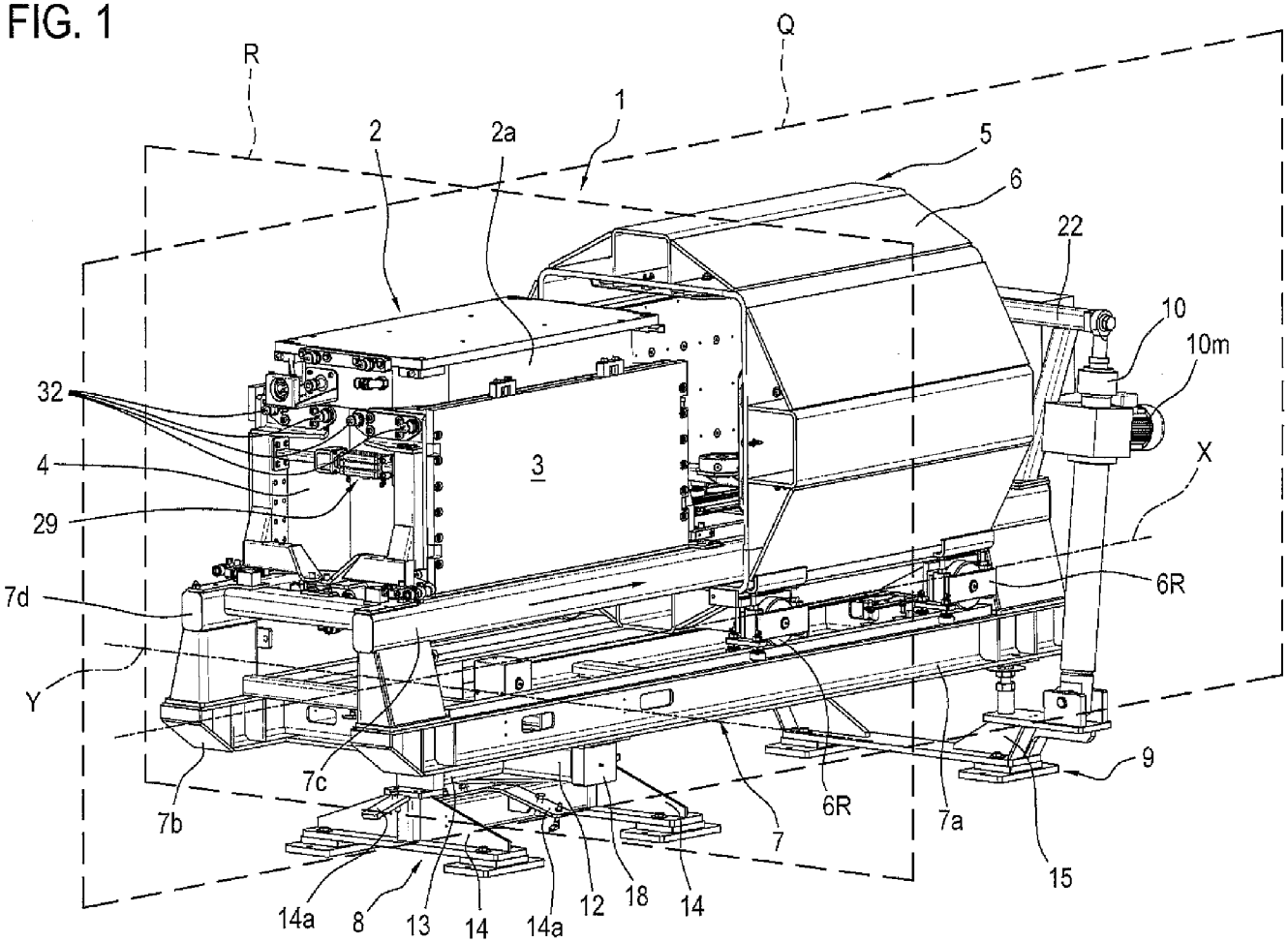
FIG. 1 is a perspective view of a non-operating configuration of a machine for the production of ceramic products, in particular ceramic sanitaryware according to this invention.
Figure 2:
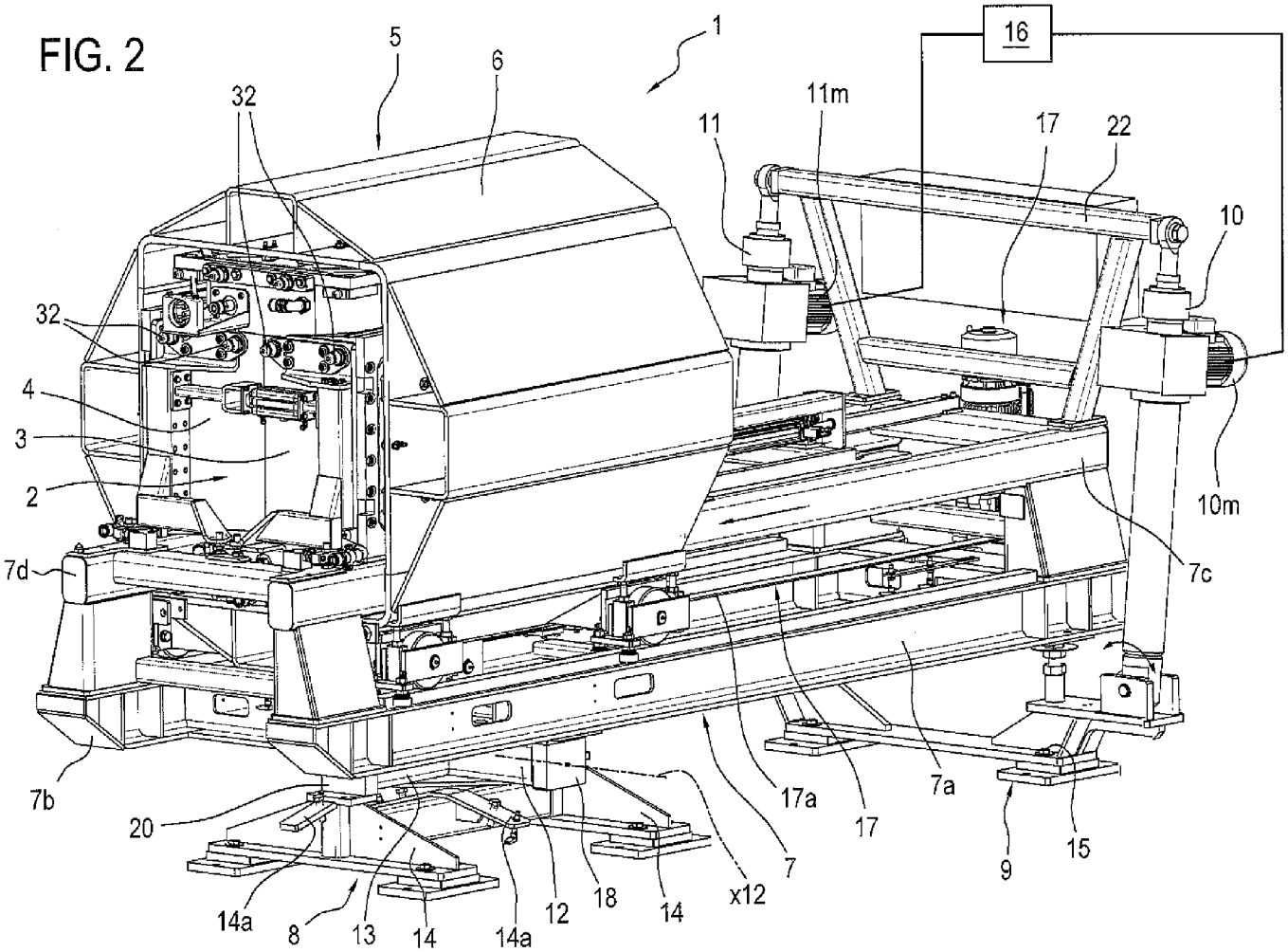
FIG. 2 is a perspective view of a first operating configuration of the machine for the production of ceramic products of FIG. 1 according to this invention.
Figure 3:
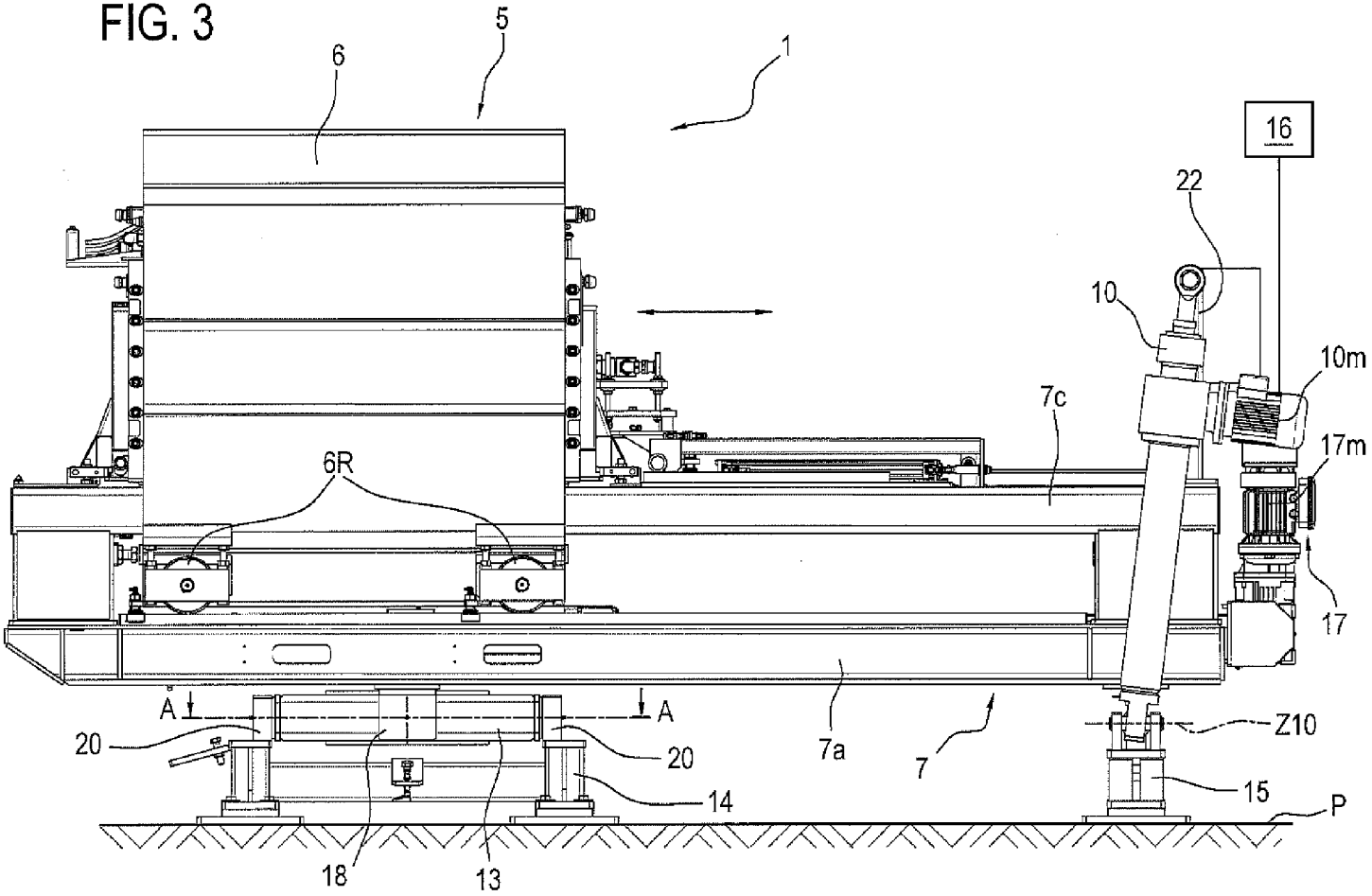
FIG. 3 is a side view of a first operating configuration of the machine for the production of ceramic products of the preceding figures.

With reference to the accompanying drawings and in particular to FIGS. 1 to 3, the machine according to this invention, denoted in its entirety by the numeral 1, is used for the production of ceramic products.

More specifically, the machine 1 is used for the production of sanitaryware, such as, for example, but without restricting the scope of the invention, toilet bowls or bidets.

The machine 1 comprises a mould 2 made up of at least two parts 3 and 4 designed to define, in a closed configuration, a cavity for casting the product.

It should be noted that the mould 2 illustrated in the accompanying drawings, merely by way of non-limiting example, comprises four parts: two side parts 3 and 4, an upper part 2*a* and a lower base (not visible). In some operating configurations the mould may also comprise a fifth part (a rear plug, not shown).

The number of parts of the mould 2 is always a function of the type of product to be produced, but the number of parts does not influence the scope of this invention.

The machine 1 also comprises means 5 for clamping and containing the mould 2 and acting on the mould 2 in its closed configuration.

More specifically, the clamping and containing means 5 comprise a tubular body 6, open at the ends, which can be coupled with the mould 2, in use (so as to form a cover on the outside closing surfaces of the mould 2).

The machine 1 also comprises a frame 7 for supporting the mould 2 and the clamping and containing means 5 (preferably placed on a walkable surface P).

The frame 7 has a longitudinal axis of extension X.

The frame 7 has a transversal axis of extension Y.

According to the invention, the machine comprises a supporting base interposed between the supporting frame 7 and a walkable surface P (that is, a floor on which the machines rest).

Also according to the invention, the supporting base has a first portion 8 pivoted to the frame 7 to allow a first rotation of the supporting frame 7 relative to the walkable surface P.

Also according to the invention, the supporting base has a second portion 9 spaced from the first portion 8.

Also according to the invention, the second portion 9 is equipped with at least one actuator element 10, 11 connected to the supporting frame 7 to incline the supporting frame 7 at least from a first limit operating position, where the supporting frame 7 is inclined by a first angle α or β relative to the walkable surface P, to a second limit operating position, where the supporting frame 7 is inclined by a second angle α or β which is different from the first angle α or β and again relative to the walkable surface P.

Also according to the invention, the first portion 8 of the supporting base is articulated to the frame 7 with a first axis of rotation Z13 lying in a plane passing through the longitudinal axis of extension X of the frame 7 to allow a first rotation of the frame 7, relative to the walkable surface P between the two limit operating positions.

Preferably, the first portion 8 of the supporting base is articulated to the frame 7 with a second axis of rotation Z12 lying in a plane at right angles to the longitudinal axis of extension X of the frame 7 to allow a second rotation of the frame 7, relative to the walkable surface P between the two limit operating positions.

Figure 4:
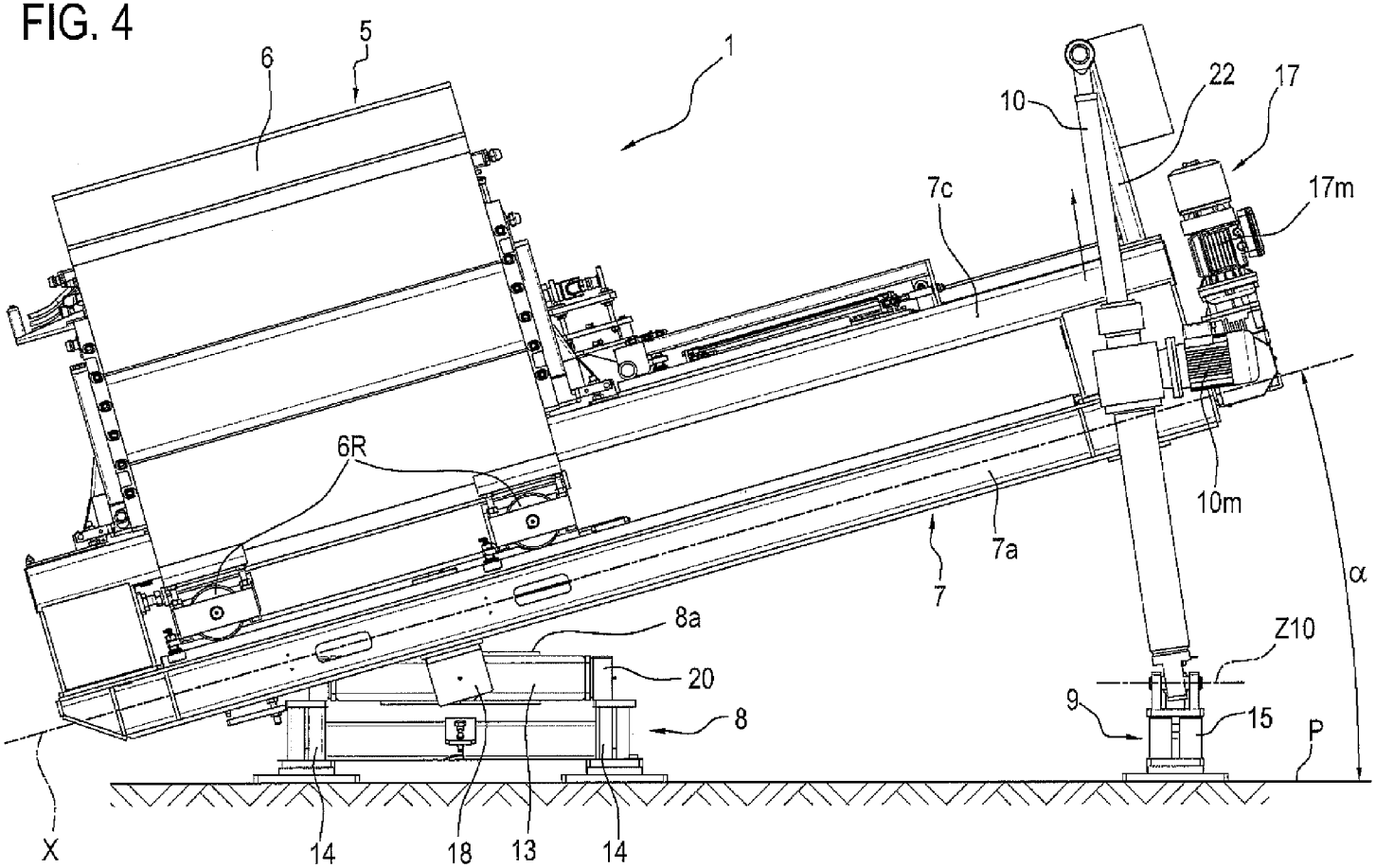
FIG. 4 is a side view of a second operating configuration of the machine for the production of ceramic products of the preceding figures.

In practice, the first portion 8 is articulated to the frame 7, with a second axis of rotation Z12 (parallel to the surface P) at a right angle to a vertical plane Q extending longitudinally to the frame 7 to allow a second rotation of the frame 7 (raising one end of the frame 7), relative to the walkable surface P between the two above-mentioned limit operating positions (see FIGS. 3 and 4 and angles α).

It should be noted that the frame 7 is inclined relative to the second axis of rotation Z12, according to angles α referred to the longitudinal axis of extension X of the frame 7.

The plane Q is clearly shown in FIG. 1 to clarify the reference system used for the second rotation of the frame 7.

As stated previously, the first portion 8 of the supporting base is articulated to the frame 7 with a first axis of rotation Z13 lying in a plane passing through the longitudinal axis of extension X of the frame 7 to allow the first rotation of the frame 7.

Figure 7:
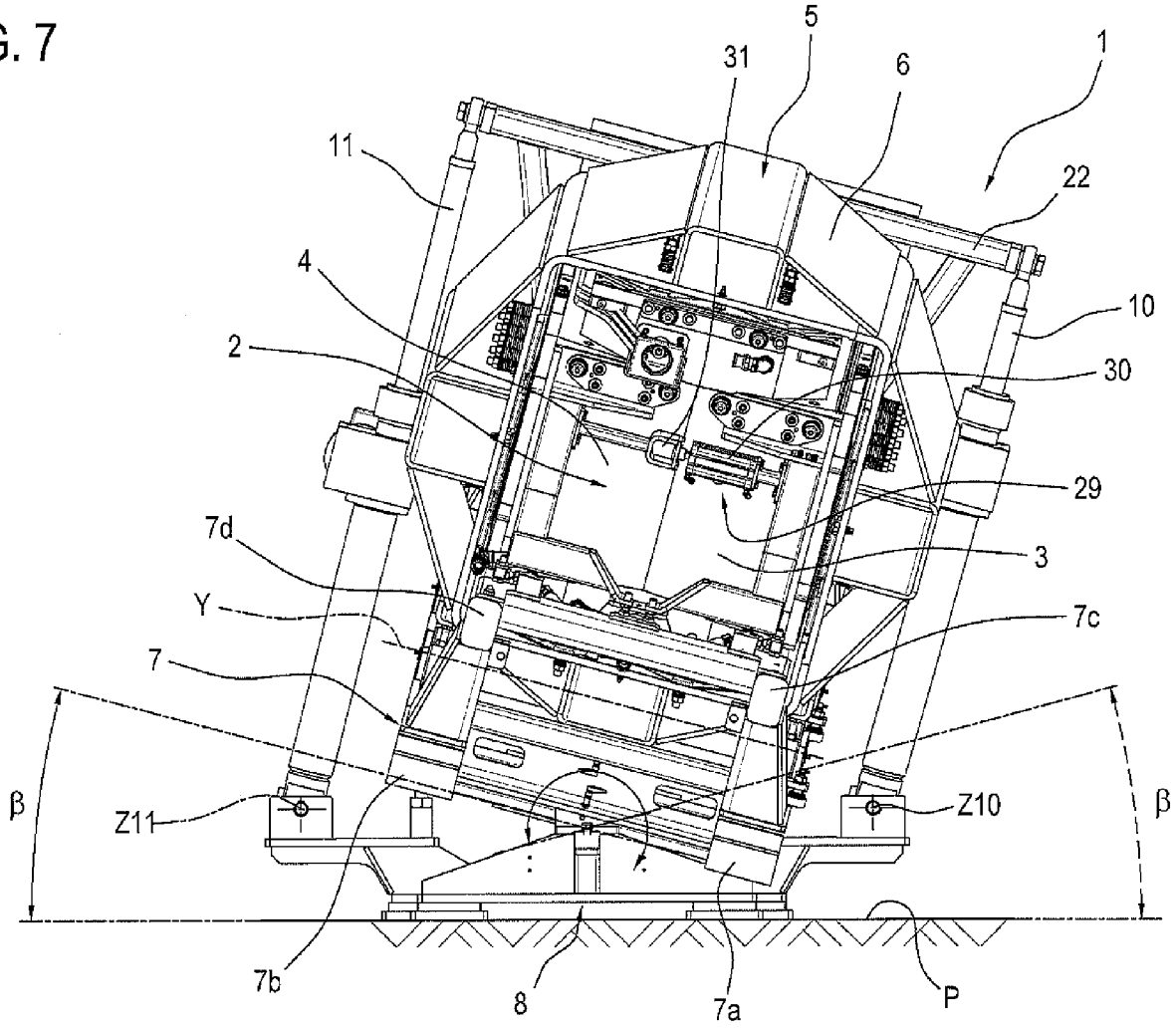
FIG. 7 is a front view of the machine of the preceding figures in a third operating configuration.

In other words, the first portion 8 of the supporting base is articulated to the frame 7 with a first axis of rotation Z13 (parallel to the surface P) at a right angle to a vertical plane R extending transversely to the frame 7 to allow a first rotation of the supporting frame 7 (see FIG. 7 and angles β). It should be noted that the frame 7 is inclined, relative to the first axis of rotation Z13, according angles β referred to the transversal axis of extension Y of the frame 7.

The plane R is also clearly shown in FIG. 1 to clarify the reference system used for the first rotation of the frame 7 (rolling).

In other words, with three points for supporting the frame 7 two different possible inclinations are obtained (also combined with each other).

Preferably, as described in more detail below and merely by way of an example, the supporting base of the frame 7 is divided into two independent portions resting on the walkable surface P.

Preferably, the second portion 9 is equipped with a pair of actuator elements 10 and 11.

In light of this, the frame 7 thus has three points for resting on the walkable surface P: a single point with double pivot point (first portion 8) at one end and a pair of points at the other end (second portion 9 with pair of actuators 10 and 11).

It should be noted that, in the embodiment illustrated, merely by way of non-limiting example, (as described in more detail below), the frame 7 is supported by two independent portions 8 and 9.

In light of this, the first portion 8 is positioned at a first end (proximal) of the frame 7.

The second portion 9 is positioned at a second end (distal) of the frame 7. The first portion 8 forms the second axis of rotation Z12 for the inclination of the frame 7 so as to guarantee complete and fast emptying of the cavity of the mould 2 at the end of the product casting cycle.

The first portion 8 also forms the first axis of rotation Z13 for the first rotation (rolling) of the frame 7.

As described below, in one of the embodiments (provided by way of non-limiting example) the first axis of rotation is coordinated and interdependent with the second axis of rotation.

The frame 7 is advantageously raised at one end (the above-mentioned second distal end) and rotated by the pair of actuators 10 and 11 present on the second portion 9.

Preferably, the frame 7 comprises a first pair of cross-pieces 7*a* and 7*b* extending horizontally and parallel to each other. The first pair of crosspieces 7*a*, 7*b* extends parallel to the longitudinal axis of extension X. Above the first pair of crosspieces 7*a* and 7*b* (and connected to them) there is a second pair of crosspieces 7*c*, 7*d* supporting the parts of the mould 2, which are positioned and drawn from a fixed part of the frame 7, that is, at one end, the proximal one, of the frame 7.

The first pair of crosspieces 7*a* and 7*b* each have profiles designed to define a rail.

In light of this, the machine 1 comprises movement means 17 acting between the clamping and containing means 5 (tubular body 6) and the supporting frame 7 for the relative sliding, in both directions, of the clamping and containing means 5 and the mould 2.

Preferably, but without restricting the scope of the invention, the tubular body 6 is made to slide along the supporting frame 7 between a first, non-operating position, where the mould 2 and the clamping and containing means 5 are moved away from each other (FIG. 1), and a second operating position, where the mould 2, in the closed configuration, and the clamping and containing means 5 are matchingly coupled one inside the other (FIGS. 2, 3 and 4).

The structure of the clamping and containing means 5, that is, of the tubular body 6 and the active containment elements contained therein, are not described here in detail, since part of the means are clearly illustrated in European patent EP 2 366 517.

The above-mentioned movement means 17 comprise a drive unit 17*m* associated with the frame 7 (on the distal end of the frame 7) for moving the tubular body 6 along the frame 7, using a connecting element 17*a* connected to the tubular body 6 and to the drive unit 17*m*.

The tubular body 6 is equipped with a plurality of wheels 6*r* resting on the rails present on the first pair of crosspieces 7*a* and 7*b* in order to be able to slide in both directions along the frame 7.

In a first embodiment, the first portion 8 comprises at least a second shaft 12 connected to the supporting frame 7 to define the second axis of rotation Z12 for the frame 7.

Figure 5:
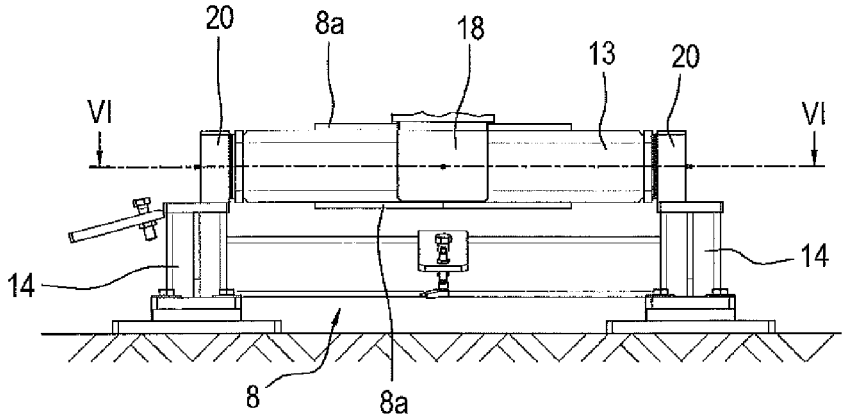
FIG. 5 shows an enlarged detail of a supporting portion of the machine of FIG. 3.
Figure 6:
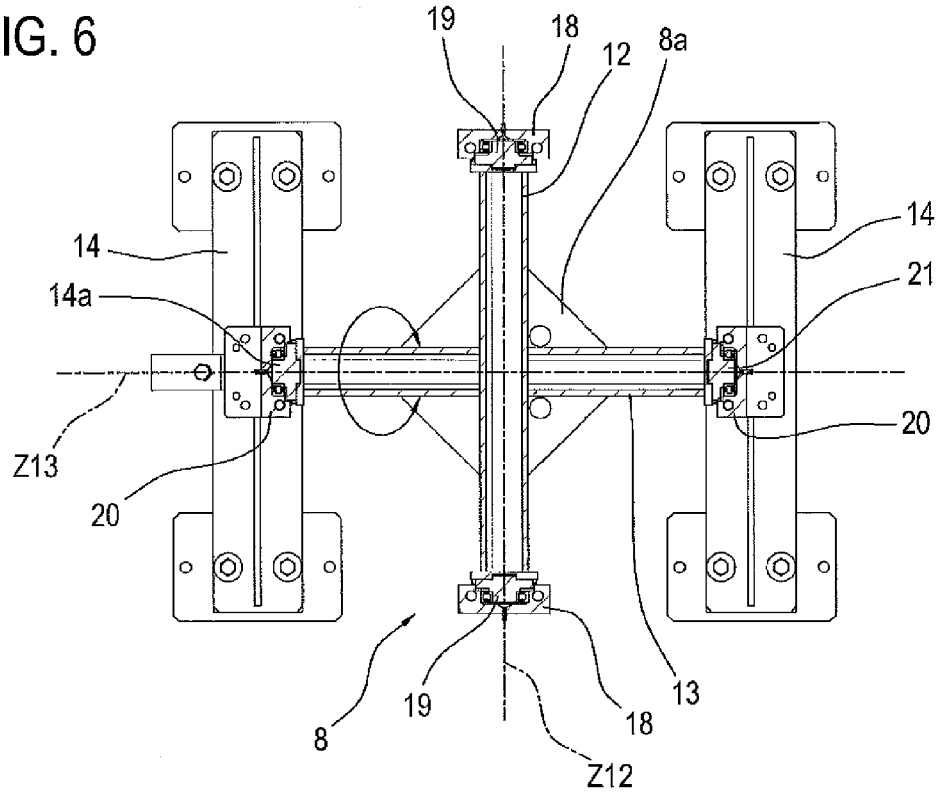
FIG. 6 is a cross-section through line VI-VI of FIG. 5.

In light of this (see also FIGS. 5 and 6), the longitudinal axis Z12 of the second shaft 12 is transversal to the frame 7.

It should be noted that the second shaft 12 has a tubular cross section.

The two ends of the second shaft 12 are connected to corresponding supports 18 protruding downwardly from the frame 7.

Between each end of the second shaft 12 and the corresponding support 18 there is interposed a rotary member 19 (bearing) to allow the rotation of the supports 18, and therefore of the frame 7, about the axis Z12.

Preferably, the first portion 8 comprises a first shaft 13 connected to a fixed plate 14 resting on the walkable surface P (forming the first supporting point of the base).

The first axis of rotation Z13 of the first shaft 13 is at right angles to the second axis of rotation Z12 of the second shaft 12.

It should be noted that the first shaft 13 has, for example, a tubular cross-section.

Moreover, the two ends of the first shaft 13 are connected to corresponding supports 20 protruding from the plate 14.

Interposed between each end of the first shaft 13 and the corresponding support 20 there is a rotary member 21 (bearing) to allow the rotation of the first shaft 13 about the first axis of rotation Z13 (axis defining a first pivot point).

In light of this, the first shaft 13 is connected stably with the second shaft 12.

More specifically, the second shaft 12 passes transversely inside the second shaft 13 in its central portion and can rotate about its own second axis Z12 (axis defining the second pivot point) and relative to the first shaft 13.

Now, considering that the second shaft 12 is connected to the supporting frame 7, the rotation of the first shaft 13 drives the second shaft 12 along with it, causing it to be inclined, in such a way as to produce the first rotation or rolling of the supporting frame 7.

Preferably, in the "cross" defined by the two shafts 12 and 13 two stiffening plates 8*a* are positioned, connected on both sides to the central zone of the cross.

Preferably (as mentioned above), the first portion 8 is positioned under the portion of frame 7 supporting the mould 2 and the clamping and containing means 5 coupled to each other. This zone forms the first end of the supporting frame 7 (or proximal end).

Figure 9:
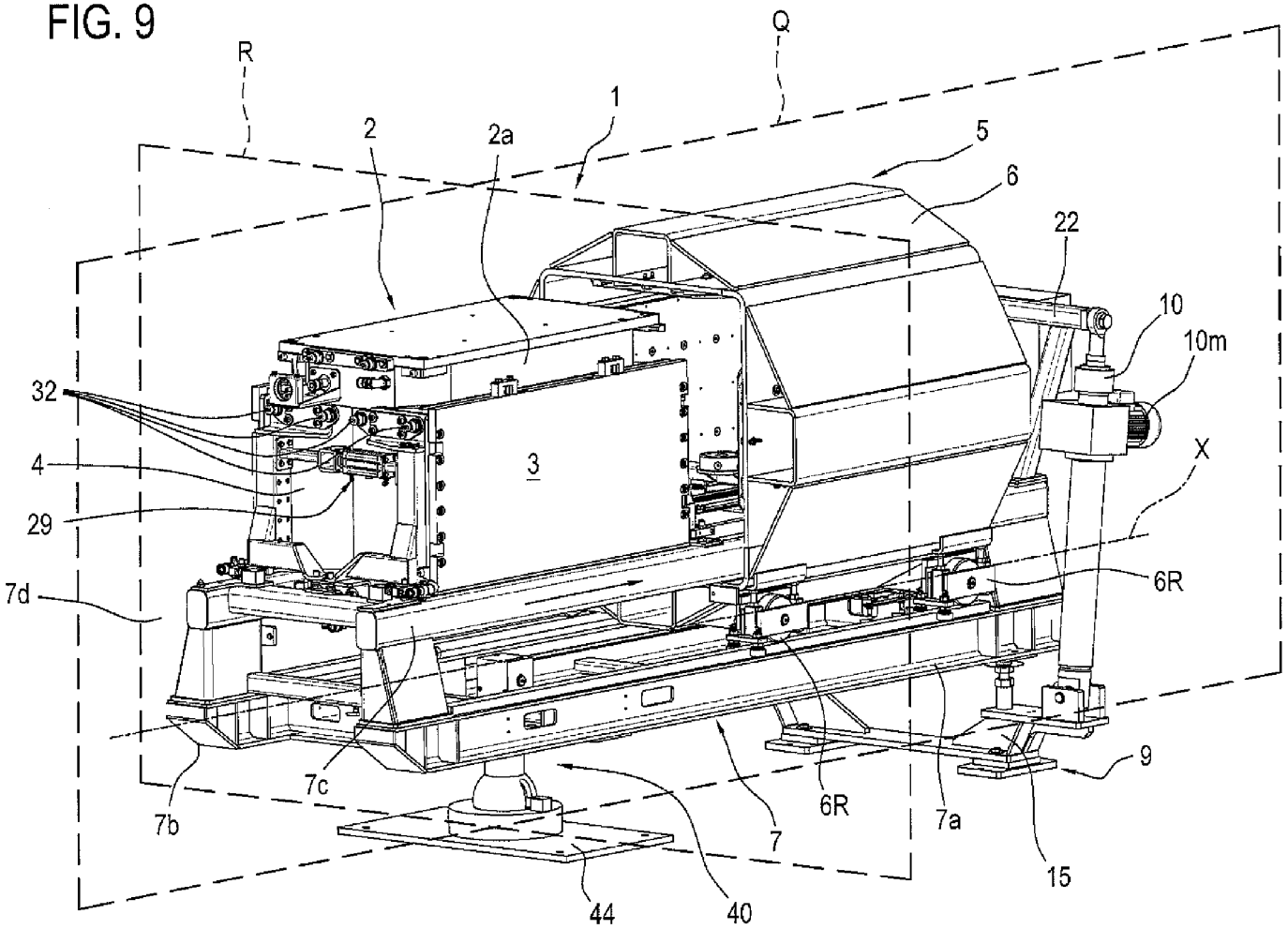
FIG. 9 is a perspective view of the machine for the production of ceramic products with an alternative embodiment of a supporting portion of the frame.
Figure 10:
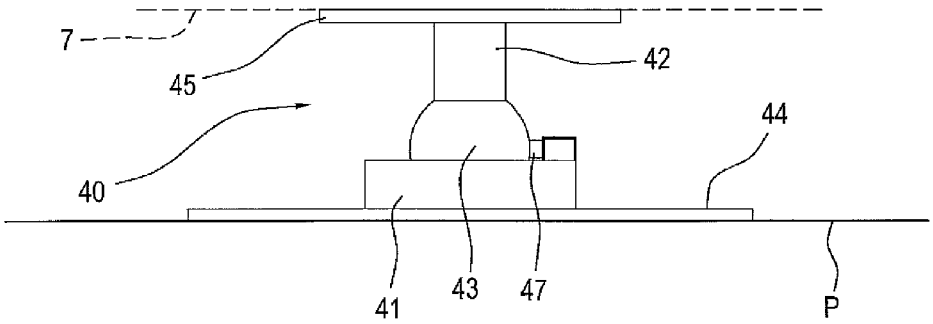
FIGS. 10 and 11 are front and perspective views, respectively, of the supporting portion of the frame of the preceding figure.
Figure 11:
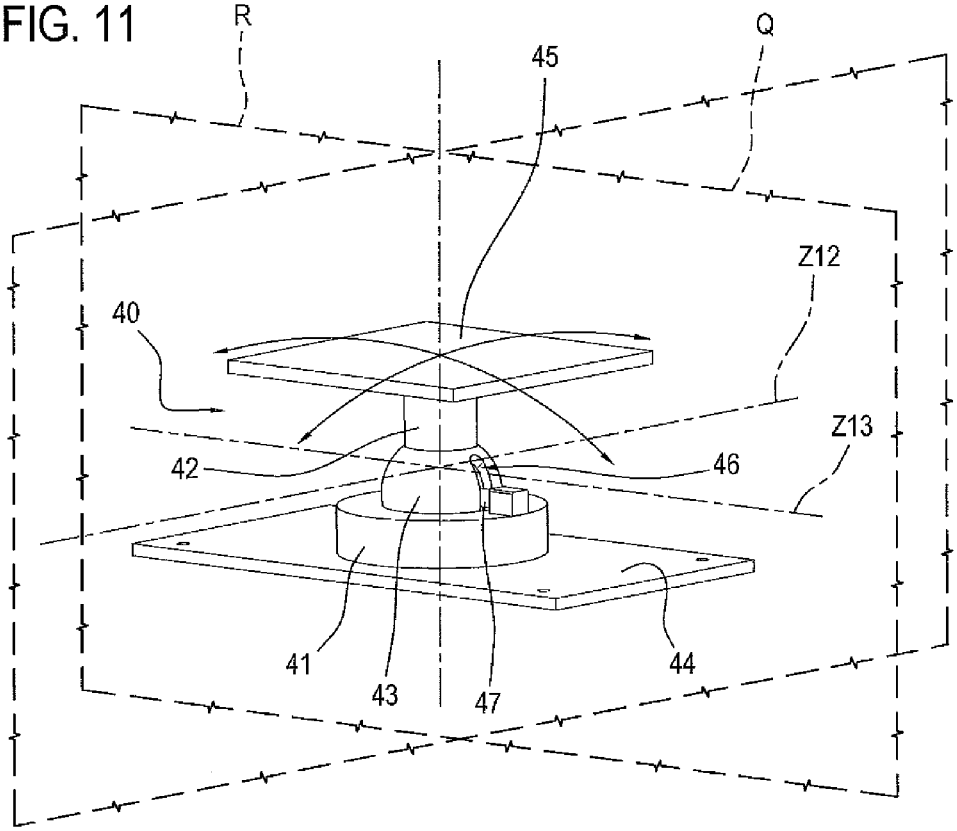

In a second embodiment illustrated in FIGS. 9 to 11, the first portion 8 of the supporting base comprises a ball joint 40 interposed between the frame 7 and the walkable surface P and forming the first and the second axis of rotation Z13 and Z12 and capable of obtaining the first and/or the second rotation of the frame 7.

In light of this, the ball joint 40 comprises a lower hemispherical cavity 41 (which is open towards the top) and a shaft 42 with spherical head 43 partly coupled in the hemispherical cavity 41 and free to rotate relative to the hemispherical cavity 41.

It should be noted that the ball joint 40 comprises a lower pedestal 44, resting on the walkable surface P on which the hemispherical cavity 43 is made.

The shaft 42 is associated, at its free upper end, with a plate 45 connected to the frame 7.

Made on the outer surface of the spherical head 43 there is a slot 46 extending parallel to the vertical plane R.

The slot 46 is engaged by a horizontal pin 47 integral with the edge of the hemispherical cavity 41.

This pin 47 allows the movements of the spherical head 43 to be limited only to the two above-mentioned first and second rotations of the frame 7 parallel to the surface P and at right angles to the vertical planes Q and R. In effect, when the frame 7 is raised during the second rotation, the spherical head 43 rotates forwards and about the pin 47, whilst during the first rotation of the frame 7 the spherical head 43 rotates in both directions and slides relative to the pin 47 thanks to the presence of the slot 46.

The above-mentioned second supporting portion 9 is positioned at the second end of the supporting frame 7 (or distal end), opposite the first end of the supporting frame 7.

In light of this, the second portion 9 comprises, preferably, a pair of actuators 10, 11 (cylinders) connected, at one end, to corresponding supporting pedestals 15 resting on the walkable surface P and, at the opposite end, on both sides connected to the supporting frame 7 and at two different points of the supporting frame 7.

It should be noted that the two pedestals 15 define the other two support points of the frame 7.

Each actuator 10, 11 has an independent movement unit 10*m*, 11*m* driven by a shared control unit 16 (illustrated with a block) which is able to activate the actuators 10,11 simultaneously or independently of each other to allow the first and/or the second rotation or rolling of the supporting frame 7.

Preferably, the two actuators 10, 11 are articulated at one end to the corresponding supporting pedestal 15 about the respective axes Z10 and Z11 parallel to the walkable surface P.

In light of this, each actuator 10, 11 is articulated at its other end to the outer end of a rigid shoulder 22 (horizontal) protruding at the distal end of the second pair of crosspieces 7*c*, 7*d* of the frame 7. This double articulation allows the actuators 10 and 11 to rotate relative to the pedestal 15 in both directions and about the axes Z10 and Z11, thus producing the first and/or the second rotation of the supporting frame 7.

The bilateral constraint of the actuators 10, 11 on the rigid shoulder 22 makes it possible to incline the frame 7 (by lifting the distal end of the frame 7) by simultaneously activating the two actuators 10, 11 (see FIG. 4).

Advantageously, the frame 7 located, for example, in a first horizontal position may be only inclined (or rolled) about only the first axis of rotation Z13 by activating the two actuators 10 and 11 in opposite coordinated directions.

The frame 7 again positioned in the first horizontal position or in a second position already partly inclined may be inclined (or rolled) by alternately activating one of the actuators 10 or 11 upwards or downwards, whilst the other actuator 11 or 10 remains stationary in its position (see FIG. 7). Alternating this type of activation, that is, lowering and raising the two actuators 10, 11 simultaneously or alternately, there is a continuous rolling of the frame 7 and therefore of the mould 2 with clamping and containing means 5, in particular during the step of filling the mould cavity with slip so that the slip fed in remains homogeneous.

In effect, this movement allows the flocculation or joint lines to be moved into positions such as not to damage the surfaces of the product being formed.

In light of this, the structure of the frame 7, of the two portions 8 and 9 of the supporting base and the sizing of the two actuators 10 and 11 determine a second inclination of the axis of extension X by an angle $\alpha$ of between at least 0° and 15°.

The structure of the machine 1 obtained in this way also allows a first rotation or rolling about the axis of extension X through the angle $\beta$ of between at least 0° and 15° in both directions of rolling.

In the first embodiment of the first portion 8, the fixed plate 14 of the first portion 8 comprises at least three tabs 14*a*, one projecting from the front side of the plate 14 and the other two tabs 14*a* projecting from the sides of the plate 14 to make contact with the frame 7 when the supporting frame 7 reaches its maximum attainable inclination during the second rotation (front side) and, respectively, when it reaches its two maximum inclinations during the first rotation (sides).

In the embodiment with the ball joint 40, the drawings show at least one end of stroke position relative for the first rotation caused by contact of the pin 47 with the ends of the slot 46, but on the same ball joint 40 there may be associated end of stroke elements similar to what is described above in the first embodiment.

The frame 7 also comprises centring means 23 for at least the two parts of the mould 2 to be positioned in the operating zone.

Preferably, the centring means 23 are located around the proximal end of the frame 7 to delimit the correct support position of the mould 2.

In light of this, the centring means 23 are preferable, since the various parts of the mould 2 are handled by a robotized unit (not illustrated) for their resting and their replacement on the frame 7.

Figure 8:
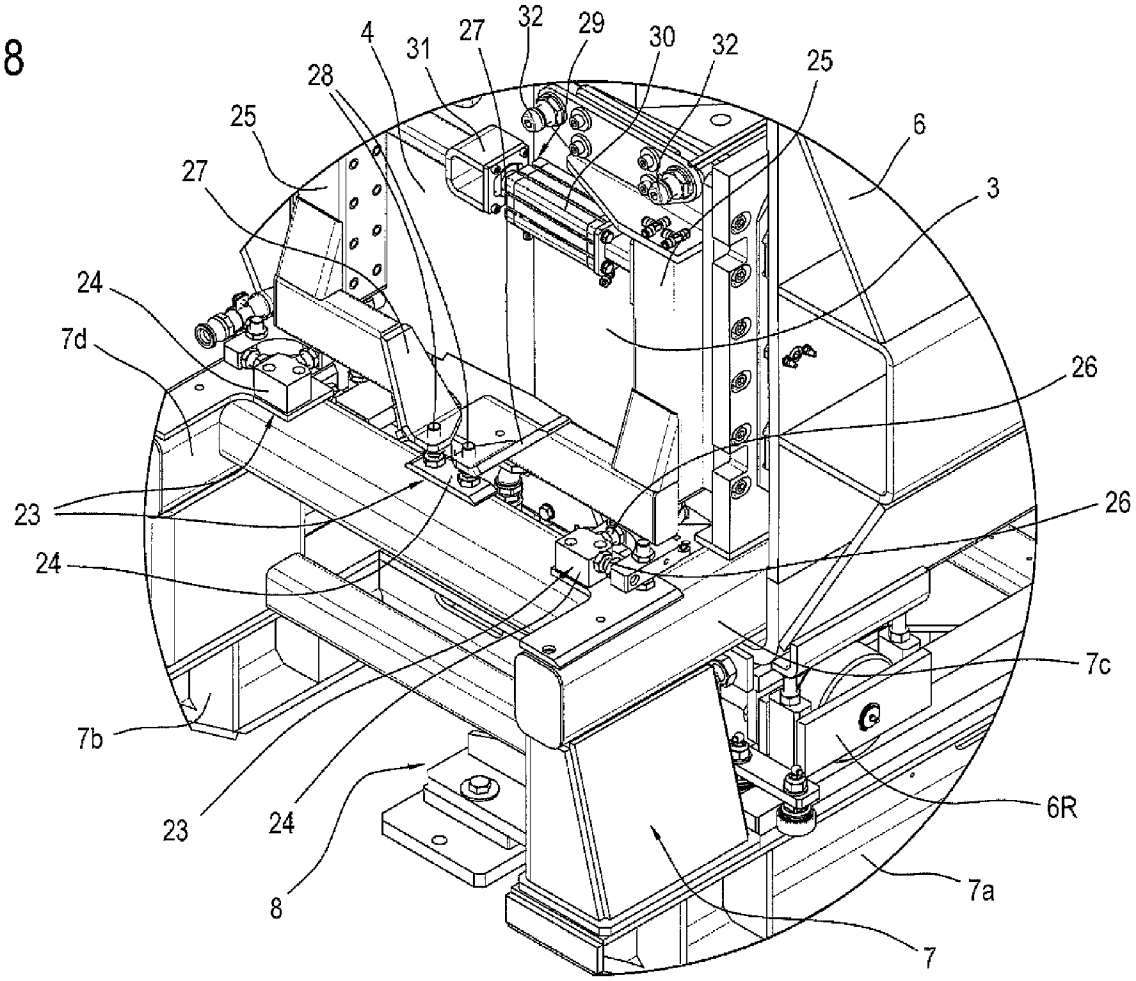
FIG. 8 illustrates a scaled-up detail from FIG. 2.

These centring means 23 comprise at least reference blocks 24 associated at predetermined points on the second pair of crosspieces 7*c*, 7*d* of the frame 7 (see in particular FIG. 8).

A set of blocks 24 defines an angular reference (four), whilst a pair of blocks 24 (one per side) defines the middle reference zone for the height (relative to the frame 7) for resting the parts of the mould 3 and 4 on the frame 7.

FIG. 8 shows only one side of the frame 7 equipped with the means 23, because the opposite side of the frame 7 is structurally similar.

The centring means 23 interact with reference plates 25, with which each of at least two parts of the mould 3, 4 is equipped and which are equipped with pre-adjusted or adjustable positioning means interacting with the centring means 23.

Preferably, each mould part 3, 4 has a plate 25 associated with a respective side of it, in particular on each side not covered, in use, by the tubular body 6.

Each plate 25 comprises a first lower pair of horizontal pins 26, at an angle to each other, for contact with corresponding surfaces, at an angle to each other, of the corner blocks 24 positioned on the frame 7.

In light of this, the surfaces of the blocks 24 are one parallel to the axis of extension X of the frame 7 and one transversal to the same axis X: in this way, resting the part of mould 3 or 4 on the frame 7 is performed according to two precise references and centred relative to the operating zone of the frame 7, without the need for any human intervention.

It should be noted that each plate 25 comprises a lower wing 27 equipped with a further vertical pin 28 for contact with the middle block 24 present on the frame 7.

The contact of this vertical pin 28 on the middle block 24 defines the correct position in height of the part of the mould 3 or 4 on the frame 7.

The surfaces of each of the blocks 24 on the frame 7 and in contact with the corresponding pins 26 and 28 have bevelled profiles to prevent jamming the part of the mould 3 or 4 during positioning.

Advantageously, each pin 26 and 28 present is pre-adjusted or subsequently adjustable along the relative axis of extension so that when it is positioned on the frame 7 for the first time, its position can be adjusted once only. More specifically, each pin 26, 28 is coupled in a cavity of the plate 25.

Each plate 25 also comprises means 29 for clamping the side of the mould 2.

More specifically, a plate 25 of one of the parts 3 or 4 of the mould 2 has a cylinder 30 (hydraulic or pneumatic) with a horizontal axis, whilst the other part 4 or 3 of the mould 2 comprises a connecting body 31 having a front opening shaped to allow the passage of the stem of the cylinder 30.

The stem of the cylinder 30 has a rotatable hammer-shaped head in such a way as to rotate inside the connecting body 31 and lock the coupling between the two parts of the mould.

In addition, the stem of the cylinder 30 may withdraw, after the locking rotation inside the tubular body, so as to increase the lateral clamping force between the parts 3, 4 of the mould 2.

Preferably, each plate 25 present on each part 3, 4 of the mould 2 has, on its upper part, at least one pair of projecting pins 32 for the coupling with a robotized unit (not illustrated) equipped with a suitable gripping arm for positioning/picking up the part 3, 4 of the mould on/from the frame 7.

A system of pre-adjusted or adjustable pins and reference blocks can also be used for the lower base of the mould (if present).

In this case, the base may have pairs of pins at the respective four sides interacting with reference blocks present inside the frame 7 in the zone for receiving the lower base for the lateral references.

There may also be further pins positioned vertically on the base to define the correct position of the base in height.

The preset aims are achieved with a machine structure obtained in this way.

The supporting bases of the frame, together with the actuators, allow the position of the mould to be modified according to the operations to be performed.

A first inclination of the frame relative to the walkable surface allows the excess liquid to be quickly and completely discharged at the end of the casting cycle.

A second inclination of the frame allows the slip, during the filling of the cavity with the forming liquid, to be kept suitably mixed and make it more homogeneous during the formation of the product.

The structure designed to allow this type of adjustment of the frame is simple and not bulky and, in effect, has a minimum effect on the costs and dimensions of the machine.

Also, the presence of a centring system between the frame and the moulds makes mould changing extremely rapid and precise, with consequent reductions in the downtimes on the production line.

Advantageously, the centring plates can be applied both to new moulds and moulds already used without affecting their functionality.

The invention claimed is:

1. A machine (1) for the production of ceramic products comprising at least:

a mould (2) made up of at least two parts (3, 4) designed to define, in a closed configuration, a cavity for casting the product;

means (5) for clamping and containing the mould (2) acting on the mould (2) in its closed configuration;

a frame (7) for supporting the mould (2) and the clamping and containing means (5) and having a longitudinal axis of extension (X) defining a first end and a second end of the supporting frame;

a supporting base, interposed between the supporting frame (7) and a walkable surface (P), having a first portion (8) pivoted to the frame (7) to allow the supporting frame (7) to rotate relative to the walkable surface (P) and a second portion (9), spaced from the first portion (8), comprising at least one actuator element (10, 11) connected to the supporting frame (7) to incline the supporting frame (7) at least from a first limit operating position, where the supporting frame (7) is inclined by a first angle (α or β) relative to the walkable surface (P), to a second limit operating position, where the supporting frame (7) is inclined by a second angle (α or β) which is different from the first angle (α or β), relative to the walkable surface (P), characterized in that the first portion (8) of the supporting base is articulated to the frame (7) with a first axis of rotation (Z13) lying in a plane passing through the longitudinal axis of extension (X) of the frame (7) to allow a first rotation of the frame (7), relative to the walkable surface between the two limit operating positions and wherein the first portion (8) of the supporting base is articulated to the frame (7) with a second axis of rotation (Z12) lying in a plane at right angles to the longitudinal axis of extension (X) of the frame (7) to allow a second rotation of the frame (7), relative to the walkable surface (P) between the two limit operating positions.

2. The machine according to claim 1, wherein the first portion (8) of the supporting base comprises a first shaft (13) connected to a fixed plate (14) resting on the walkable surface (P); the first shaft (13) defining the first axis of rotation (Z13).

3. The machine according to claim 1, wherein the first portion (8) of the supporting base comprises at least one second shaft (12) connected to the supporting frame (7) and defining the second axis of rotation (Z12) of the frame (7).

4. The machine according to claim 1, wherein a first shaft (13) is coupled to a second shaft (12), connected to the supporting frame (7), in such a way as to produce the first rotation of the supporting frame (7) through the agency of the second shaft (12).

5. The machine according to claim 1, wherein the first portion (8) of the supporting base comprises a ball joint (40) interposed between the frame (7) and the walkable surface (P) and forming the first axis of rotation (Z13) and the second axis of rotation (Z12) and capable of obtaining the first and/or the second rotation of the frame (7).

6. The machine according to claim 1, wherein the first portion (8) of the supporting base is positioned under a portion of the frame (7) supporting the mould (2) and the clamping and containing means (5) coupled to each other and defining a first end of the supporting frame (7).

7. The machine according to claim 1, wherein the second portion (9) of the supporting base is positioned at the second end of the supporting frame (7), opposite to the first end of the supporting frame (7).

8. The machine according to claim 1, wherein the second portion (9) of the supporting base comprises at least a second actuator element (10, 11), the first and second actuator elements forming a pair of actuators (10, 11) and being connected, at one end, to corresponding supporting pedestals (15) resting on the walkable surface (P) and, at the opposite end, on both sides connected to the supporting frame (7) and at two different points of the supporting frame (7); each of the pair of actuators (10, 11) having an independent movement unit (10*m*, 11*m*) driven by a shared control unit (16) which is able to activate the actuators (10, 11) simultaneously or independently to allow the first and/or the second rotation of the supporting frame (7).

9. The machine according to claim 8, wherein at least the pair of actuators (10, 11) is articulated at one end to the corresponding supporting pedestal (15) about corresponding axes (Z10) and (Z11) which are parallel to the walkable surface (P); the pair of actuators (10, 11) being connected, at the other end, to the corresponding outer ends of a rigid shoulder (22) protruding from the frame (7) so as to be able to rotate relative to the pedestal (15), in both directions about the axes (Z10, Z11) in order to obtain the first and/or the second rotation of the supporting frame (7).

10. The machine according to claim 1, comprising movement means (17) acting between the clamping and containing means (5) and the frame (7) for the relative sliding, in both directions, between the clamping and containing means (5) and the mould (2), along the supporting frame (7), between a first, non-operating position, where the mould (2) and the clamping and containing means (5) are moved away from each other, and a second operating position, where the mould (2), in the closed configuration, and the clamping and containing means (5) are matchingly coupled inside one another.

* * * * *